United States Patent [19]

Ingvast et al.

[11] Patent Number: 4,480,723

[45] Date of Patent: Nov. 6, 1984

[54] MARSHALLING YARD RETARDER

[75] Inventors: Håkan Ingvast; Bo Karlsson, both of Själevad, Sweden

[73] Assignee: AB Hägglund & Söner, Örnsköldsvik, Sweden

[21] Appl. No.: 360,784

[22] Filed: Mar. 22, 1982

[30] Foreign Application Priority Data

Mar. 24, 1981 [SE] Sweden ..... 8101869

[51] Int. Cl.[3] ..... B61B 1/00; B61K 7/02; F61D 57/00

[52] U.S. Cl. ..... 188/62; 104/26 A; 104/252; 104/257; 188/290

[58] Field of Search ..... 104/26 A, 252, 257; 188/62, 290

[56] References Cited

U.S. PATENT DOCUMENTS 3,128,721 4/1964 McGowan ..... 188/62 X
3,332,519 7/1962 Danieli ..... 188/62

FOREIGN PATENT DOCUMENTS 352035 4/1973 Sweden ..... 104/26 A
361445 2/1974 Sweden ..... 104/26 A
419530 11/1981 Sweden ..... 104/26 A

*Primary Examiner*—Howard Beltran
*Attorney, Agent, or Firm*—Watson, Cole, Grindle & Watson

[57] ABSTRACT

In a retarder system for railway wagons, a retarder device which includes a rotatable cylinder resiliently urged into a working position adjacent a rail and provided with a flange with a helical contact surface. The flange of a railway wagon wheel which passes in a working or first direction influences the contact surface of the cylinder to set the cylinder rotating thereby pumping a hydraulic medium through a throttled opening to obtain a braking action. The cylinder is provided with an elongated projection arranged parallel to the axis of the cylinder, which extends radially from the cylinder and is directed, in a position of readiness of the cylinder, substantially towards the rail. Upon passage of a wheel of a railway wagon, travelling in a return or second direction opposite to the first direction, past the retarder device, the projection acts to prevent the cylinder from being rotated about its axis when the wheel contacts the flange to move the cylinder against the resilient biasing out of its working position.

5 Claims, 4 Drawing Figures

FIG. 3
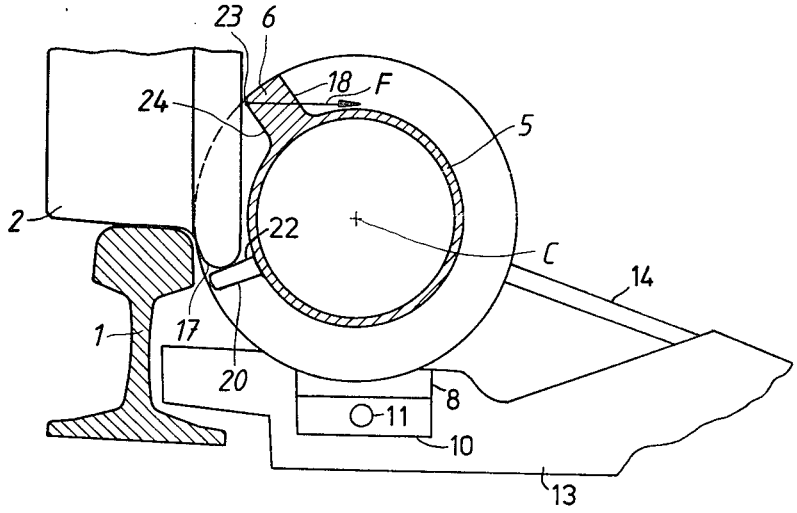
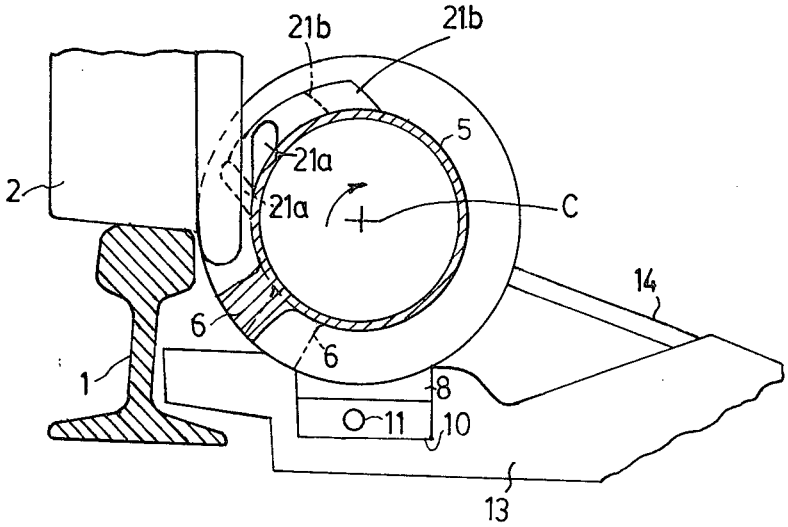
FIG. 4

MARSHALLING YARD RETARDER

BACKGROUND OF THE INVENTION

1. Field of the Invention

This invention relates to a retarder system for railway wagons of the kind comprising a track for railway wagons, a retarder device including a cylinder which is rotatable about its axis and is arranged substantially parallel to a rail of the track, and a helically extending flange, on the surface of the cylinder, provided with a wheel-contactable surface arranged to set the cylinder in rotation under the influence of a rail-engaging wheel of a wagon travelling along the track in a first direction. The rotational resistance of the cylinder then provides a braking action on the passing railway wagon. This rotational resistance can be accomplished by a hydraulic retarder built into the rotatable unit and operating by throttling the flow of a hydraulic medium, e.g. oil. The throttling may be speed dependent so that a braking action is only achieved at a certain speed, for example 3 m per second, of travel of the railway wagon. The system is particularly suitable for employment in marshalling yards.

2. Description of the Prior Art

Retarder systems of the kind referred to above are known as for example by U.S. Pat. No. 3,332,519 and Swedish Pat. Nos. 352,035 and 361,445. These known retarder systems are normally intended to retard railway wagons running in one direction only. To allow locomotives and, possibly other railway wagons to pass in a return or second direction opposite to the working or first direction, the known retarder systems may be provided with movable, e.g. pivotable, braking cylinder means. Typically, in a known retarder system provided with a pivotable cylinder means, the latter is pivotable between a working position and a pivoted position, and can be operated between these positions by hydraulic, pneumatic or electric operating members.

It is desirable for a locomotive or railway wagon to be able to pass the retarder device in the return direction when the cylinder is in its working position without any substantial retarding of the passing locomotive or railway wagon and without the risk of damage to the retarder device. This can be achieved by holding the brake cylinder in its working position in such a way that it is moved, e.g. pivoted, resiliently away from the rail when a flange of a passing rail-engaging wheel, during passage in the return direction, influences the helical flange of the brake cylinder. However, a problem in connection with the passage in the return direction has been to prevent the cylinder from being rotated about its axis from its normal position of readiness to an undesired angular position which reduces the braking capacity of the retarder device. One method of solving this problem is disclosed in Swedish Pat. No. 419,530. This patent discloses a fill portion at the rear side of the helical flange, i.e., the side opposite the contact surface thereof, to prevent the cylinder from being rotated about its axis from its normal position of readiness to an undesired angular position.

The aim of the present invention is to provide a retarder system in which a locomotive or railway wagon may pass the retarder device without a brake cylinder of the latter being moved out of its normal working position prior to the return passage of the locomotive or railway wagon. The brake cylinder is arranged so as to be moved resiliently from it normal working position under the influence of a flange of a passing rail-engaging wheel.

SUMMARY OF THE INVENTION

According to one aspect of the present invention, in a retarder system for railway wagons comprising a track for railway wagons, and a retarder device including a cylinder which is rotatable about its axis and is arranged substantially parallel to a rail of the track, the cylinder being mounted to enable it to be moved into and out of a wagon-retarding, working position adjacent the rail, a biasing device resiliently urging the cylinder towards, or to be maintained in, the working position, and a helically extending flange, on the surface of said cylinder, provided with a wheel-contactable surface arranged to set the cylinder in rotation, when the latter is in its working position, under the influence of a rail-engaging wheel of a railway wagon travelling along the track in a first direction, the cylinder being angularly oriented relative to its axis in a position of readiness after being rotated by a wheel of a railway wagon travelling along the track in the first direction, the cylinder being mounted so that a rail-engaging wheel of a railway wagon travelling along the track in a second direction, opposite to said first direction, contacts the flange and moves the cylinder, against the resilient urging of the biasing device, out of the working position to allow substantialy unretarded progress of the railway wagon along the track in the second direction, the improvement wherein there is provided a radial projection on the surface of the cylinder and spaced from the flange so as to cooperate with a rail-engaging wheel of a railway wagon as it travels along the track in the second direction and prevent any substantial turning of the cylinder about is axis when the flange is contacted by the rail-engaging wheel and the cylinder is subsequently moved away from the rail out of the working position.

According to another aspect of the present invention, in a retarder system for railway wagons comprising a track for railway wagons, and a retarder device including a cylinder which is rotatable about its axis and is arranged substantially parallel to a rail of the track, the cylinder being mounted to enable it to be moved into and out of a wagon-retarding, working position adjacent the rail, a biasing device resiliently urging the cylinder towards, or to be maintained in, the working position, and a helically extending flange, on the surface of said cylinder, provided with a wheel-contactable surface arranged to set the cylinder in rotation, when the latter is in its working position, under the influence of a rail-engaging wheel of a railway wagon travelling along the track in a first direction, the improvement wherein there is provided a radial projection on the surface of the cylinder, which projection is spaced from the flange and is directed towards the rail when the cylinder is in its position of readiness thereby to cooperate with a rail-engaging wheel of a railway wagon as it travels along the track in a second direction opposite to the first direction, to prevent any substantial turning of the cylinder about its axis when the flange is contacted by the trail-engaging wheel.

BRIEF DESCRIPTION OF THE DRAWINGS

The invention will now be described, by way of example, with reference to the accompanying drawings, in which:

FIG. 3 is a sectional view, on an enlarged scale, taken along the line A—A of FIG. 2, and FIG. 4 is a sectional view, similar to FIG. 3, taken along the line B—B of FIG. 2.

Figure 1:
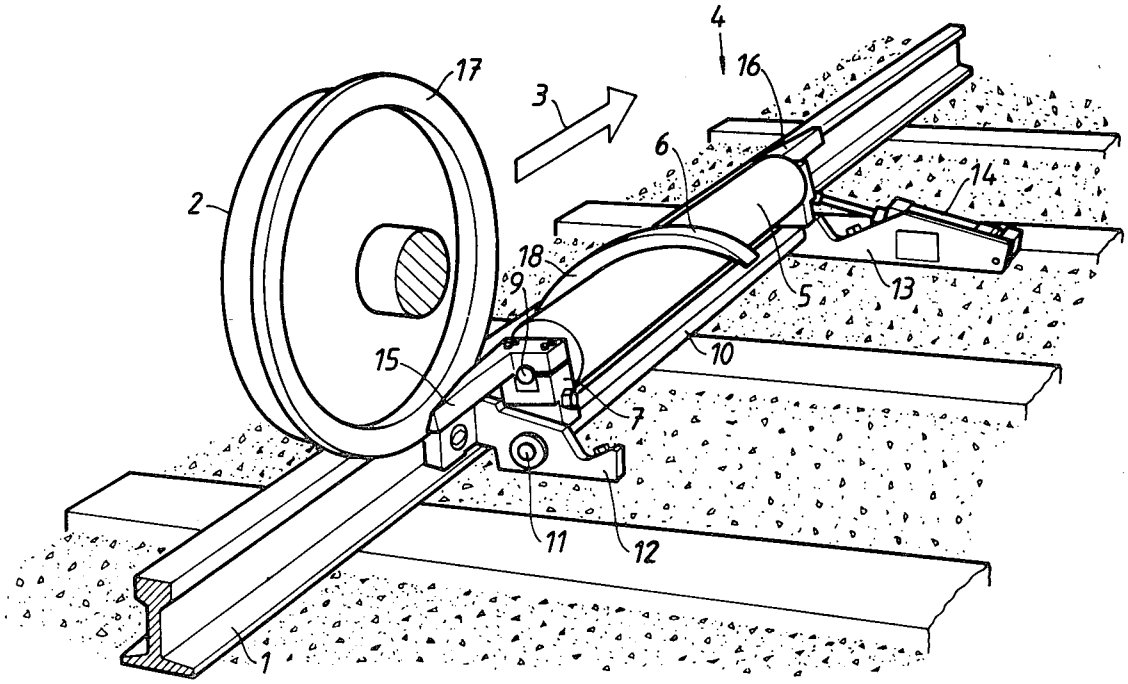
FIG. 1 is a perspective view of a retarder system according to the invention, with reference to a rail wheel.

In the drawings, the reference numeral 1 designates a rail of a railway track and the reference numeral 2 designates a railway or rail-engaging wheel of a railway wagon (i.e. a railway car, truck or locomotive) running on the track. The normal running direction for a railway wagon running on the track, i.e. a first or working direction, is indicated by an arrow 3 and the opposite running direction is referred to as the second or return direction. Fixed, e.g. bolted, to a portion of the rail 1 is a retarder device 4 comprising a rotatable cylinder 5 having an axis C (see FIG. 3) and provided with a helical flange 6 projecting from its surface and extending through approximately 360°. Inside the cylinder 5 is a hydraulic pump (not shown), e.g. an axial piston pump, which pumps hydraulic medium, e.g. oil, on turning of the cylinder about its axis C, through valve means having a throttled opening to provide braking power. The cylinder 5 is journalled on an axial shaft 9 which is supported at its opposite ends by arms 7 and 8, respectively. A stationary portion of the hydraulic pump is connected to the shaft 9. The arms 7 and 8 are attached to a longitudinally extending bar 10 arranged parallel to the axis C and provided with shaft pins 11. The shaft pins 11 at opposite ends of the bar 10 are journalled in brackets 12 and 13, respectively, which are attached to the rail 1. Thus, the cylinder 5 is pivotally mounted for pivotal movement about the axis of the shaft pins 11 and is maintained in a working position adjacent the rail 1 (shown in FIGS. 1, 2 and 3) by a spring device 14 which is journalled in the arm 8 and in the bracket 13. Although the spring device 14 resiliently urges the cylinder 5 into its working position, the latter can be pivoted away from the rail 1 and out of its working position if sufficient force is applied to the cylinder 5 to overcome the resilient urging of the spring device 14.

The arms 7 and 8 are provided with guides 15 and 16, respectively, which, in use, prevent a flange 17 of the wheel 2 from contacting the opposite axial end faces of the cylinder 5. In particular each guide ensures that the wheel flange 17 is guided into the space formed between the cylindrical surface of the cylinder 5 and the top portion of the rail 1. When the wheel 2 runs in the working direction 3, the wheel flange 17 is guided so as to make contact with a contact surface 18 of the helical flange 6 and set the cylinder 5 in rotation about its axis C. The brake cylinder 5 is designed so as to stop turning about its axis C in such an angular position (i.e. the position of readiness of the cylinder) when a wheel leaves the cylinder 5 such that the flange 17 of the next wheel 2 will contact the surface 18 of the flange 6 near the entry end of the cylinder 5. Conveniently this is achieved by designing the retarder device 4 so that the helical flange 6 extends through one or more complete turns only. As previously mentioned the flange 6 shown in FIGS. 1 to 3 extends through approximately 360°.

Figure 2:
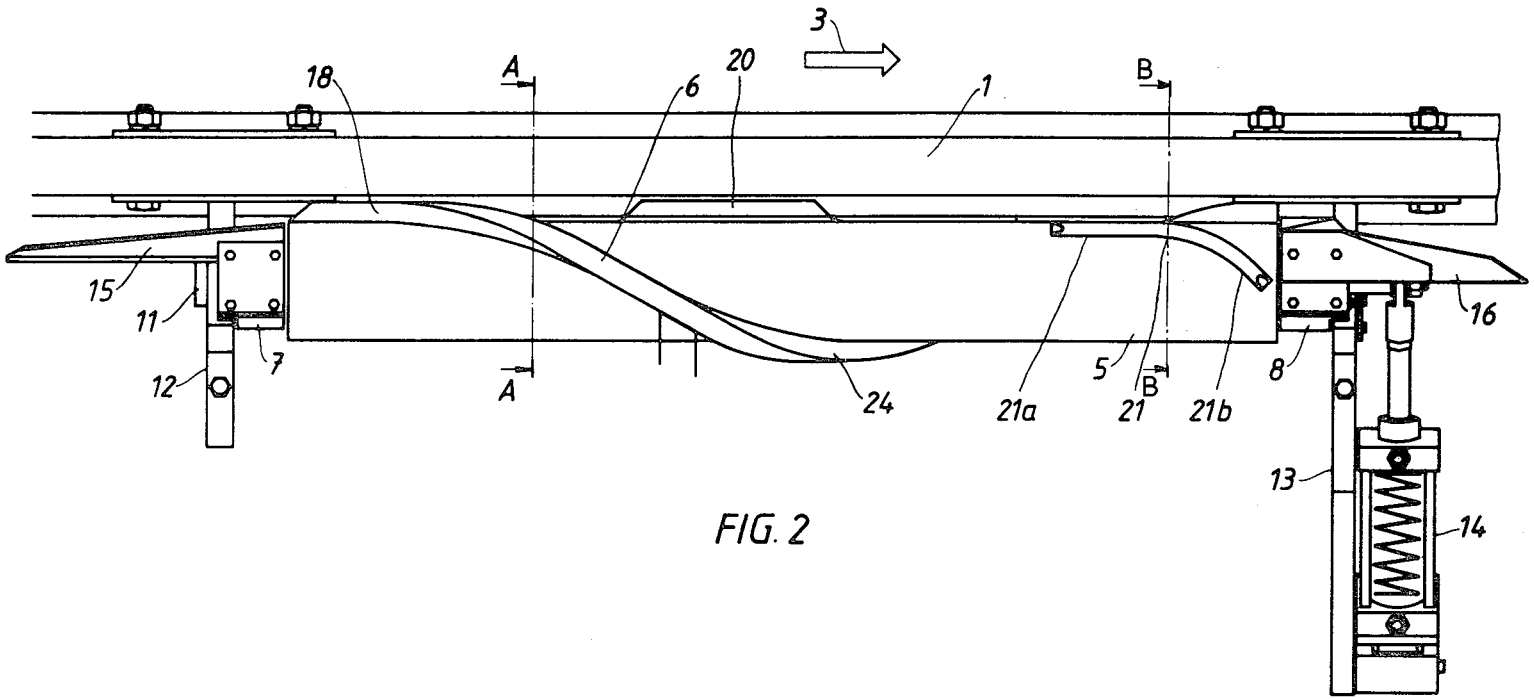
FIG. 2 is a top plan view of the retarder system of FIG. 1, without the rail wheel.

As can be seen in FIGS. 2 and 3, the cylinder 5 is also provided with a projection, typically in the form of an elongated second flange 20 arranged parallel to the axis C, which projects radially approximately the same distance as the helical flange 6, and with a third flange 21 having an elongated portion **21*a* and a curved portion 21*b*. The flange 20 is circumferentially spaced from the flange 6 at the rear side 24 of the flange 6, is preferably positioned on the front axial half of the cylinder 5 (as viewed from a wagon approaching the device 4 and travelling in the working direction 3), and is preferably arranged so that an axial plane of the cylinder 5 passing through the flange 20 also passes through opposite end portions of the flange 6. Reference to rear side 24 is that side which does not serve as a contact surface for the wheel flange 17 when a car passes in the normal running direction 3. When the cylinder 5 is in its position of readiness in its working position, the flange 20 is located at such a distance from the flange 6 that its upper surface 22 is located at substantially the same level as the lowermost portion of the flange 17 on a wheel 2. Furthermore the flange 20 is arranged on the cylinder 5 in such a position that it is immediately below a portion of the wheel flange 17 when the flange of a wheel running in the second or return direction makes initial contact with a corner region 23 of the flange 6. As can be seen in FIG. 3, the corner region 23, where the flange 17 makes initial contact with the flange 6, is located above the axis C of the cylinder 5 and at this corner region a force F is applied by the passing wheel which is sufficient to overcome the force applied by the spring device 14 and pivot the cylinder 5 out of its working position to permit the wheel to pass along the rail 1 past the retarder device 4. However the force F generates a torque which endeavours to rotate the cylinder 5 about its axis C in a clockwise direction, as viewed in FIG. 3, out of its position of readiness. If allowed, such a rotation would dispose the cylinder 5 so that it was not in its position of readiness when the cylinder 5 was returned by the spring device 14 to its working position. The cylinder would then have such an angular position, relative to the axis C, that the subsequent passage of a wheel 2 rolling in the working direction would result in the flange 17 of the wheel contacting the flange 6 only in the rear axial half of the cylinder 5. Thus approximately half (i.e. approximately 180° of turn) of the flange 6 would not be contacted, and the braking power would be consequently reduced by about 50%, which is a significant reduction. This undesired rotation or turning of the cylinder 5 about its axis C is prevented by the flange 20 and by the wheel flange 17. As can be seen in FIG. 3, the position of the flange 20 immediately beneath the wheel flange 17 prevents rotation of the cylinder 5 about its axis C at least while the cylinder 5 is pivoted out of its working position about the axis of the pins 11**.

The purpose of the flange 21 is to ensure that the cylinder 5 stops turning about its axis C in the correct position of readiness (FIGS. 2, 3 and 4) when a wheel 2 travelling in the working direction leaves the cylinder 5. At low railway wagon speeds, the brake cylinder 5 has no, or only a slight braking action and, after the wheel has left the helical flange 6, possesses rotational inertia. Unless the cylinder 5 is checked, the rotational inertia would enable the cylinder 5 to assume an angular position which deviates from the desired position of readiness. This undesired rotation is prevented by the portion **21*a* of the flange 21, as shown in solid outline in FIG. 4, impacting an axially facing portion of the wheel flange 17 so that the rotation is stopped when the cylinder 5 is in its desired position of readiness of FIG. 4**.

The angular position of the cylinder 5 relative to its axis C is also dependent on the height of the wheel flange 17. After a wheel 2 with a low wheel flange 17 and travelling in the working direction 3 has passed the brake cylinder 5, the exit end portion of the flange 6 will be located at such a height that a wheel 2 with a high flange 17 and subsequently passing the retarder device 4 in the return direction, will contact this exit end portion of the flange 6 and rotate the cylinder 5. This rotation of the cylinder about its axis C turns the latter out of its desired position of readiness into a position shown in phantom outline in FIG. 4. However upon contact between curved portion 21*b* (when in its phantom outline position of FIG. 4) and the side of the wheel flange 17, the curved portion 21*b* of the flange 21 arrests this undesired rotation and returns the cylinder 5, in the direction of the arrow in FIG. 4, to the proper position of readiness.

The retarder system described above may be modified in many ways within the scope of the appended claims.

What is claimed is:

1. A retarder system for railway wagons, comprising:

a track for railway wagons; and a retarder device including a cylinder rotatable about its axis and arranged substantially parallel to a rail of the track;

said cylinder being mounted for pivotal movement, about an axis parallel to the rail, from a wagon-retarding, working position adjacent said rail, and out of said position away from the rail;

biasing means resiliently urging the cylinder towards said working position; and a helically extending and radially projecting first flange, on the surface of said cylinder, provided with a wheel-contactable surface arranged to set the cylinder in rotation, when the latter is in its working position, under the influence of a rail-engaging wheel of a railway wagon travelling along the track in a first direction, the cylinder being angularly orientated relative to its axis in a position of readiness after being rotated by a wheel of a railway wagon travelling along the track in the first direction;

the cylinder being mounted so that a rail-engaging wheel of a railway wagon travelling along the track in a second direction, opposite said first direction, contacts the first flange and pivotally moves the cylinder, against the resilient urging of the biasing means, out of said working position to allow travel of the railway wagon along the track in the second direction; wherein the improvement comprises:

the provision of a second flange projecting radially from the surface of said cylinder in a direction toward the rail at a location to be contacted by the lowermost portion of a flange of a rail-engaging wheel of a railway wagon in the position of readiness of said cylinder, said second flange lying substantially parallel to the axis of said cylinder, extending partially along the length of said cylinder, and being spaced from said first flange, whereby said second flange cooperates with the flange of the rail-engaging wheel as it travels along the track in the second direction and prevents any substantial turning of said cylinder about its axis in the position of readiness when the first flange is contacted by the rail-engaging wheel and the cylinder is subsequently moved away from the rail out of said working position.

2. A retarder system according to claim 1, wherein said first and second flanges have substantially the same radial extent.

3. A retarder system according to claim 1, wherein the upper surface of said first flange, when the cylinder is in its position of readiness in said working position, is positioned beneath the upper surface of the rail so as to be at substantially the same level as the lowermost portion of the flange of a rail-engaging wheel of a railway wagon travelling along the track past the retarder device.

4. A retarder system according to claim 1, wherein the second flange is positioned on the front axial half of the cylinder with respect to a railway wagon travelling along the track in the first direction.

5. A retarder system according to claim 1, wherein the second flange is positioned so that an axial plane of the cylinder passing through the second flange also passes through opposite end portions of the first flange.

* * * * *